United States Patent [19]

Ogawa

[11] Patent Number: 4,735,894

[45] Date of Patent: Apr. 5, 1988

[54] SILVER HALIDE PHOTOGRAPHIC EMULSION AND PHOTOGRAPHIC MATERIAL CONTAINING THE SAME WHICH COMPRISE JUNCTION-TYPE SILVER HALIDE CRYSTAL GRAINS

[75] Inventor: Tadashi Ogawa, Kanagawa, Japan

[73] Assignee: Fuji Photo Film Co., Ltd., Kanagawa, Japan

[21] Appl. No.: 853,289

[22] Filed: Apr. 17, 1986

[30] Foreign Application Priority Data

Apr. 17, 1985 [JP] Japan ..... 60-081808

[51] Int. Cl.[4] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 3,885,970 | 5/1975 | Miyahara | 430/567 |
| 4,094,684 | 6/1978 | Maskasky | 430/567 |
| 4,184,878 | 1/1980 | Maternaghan | 430/567 |
| 4,463,087 | 7/1984 | Maskasky | 430/567 |
| 4,471,050 | 9/1984 | Maskasky | 430/567 X |
| 4,496,652 | 1/1985 | Haugh et al. | 430/567 X |

FOREIGN PATENT DOCUMENTS 0149933 11/1980 Japan .

*Primary Examiner*—Mukund J. Sham

*Attorney, Agent, or Firm*—Sughrue, Mion, Zinn, Macpeak, and Seas

[57] ABSTRACT

A silver halide photographic emulsion is described, comprising junction-type silver halide crystal grains composed of cubic, rectanguloid, or tetradecadedral silver halide crystals as a first type of silver halide crystal, having projection-joined to at least one of the six (100) faces of said first type of silver halide crystal a second type of silver halide crystal having a different halogen composition from the halogen composition of the surface of the first type of silver halide crystal. A silver halide photographic material containing the foregoing photographic emulsion is also described.

18 Claims, 3 Drawing Sheets

SILVER HALIDE PHOTOGRAPHIC EMULSION AND PHOTOGRAPHIC MATERIAL CONTAINING THE SAME WHICH COMPRISE JUNCTION-TYPE SILVER HALIDE CRYSTAL GRAINS

FIELD OF THE INVENTION

This invention relates to a novel silver halide photographic emulsion and a photographic material containing the same. More specifically, the invention relates to a silver halide photographic emulsion comprising silver halide grains of specific crystal form which can provide a photographic material having high sensitivity, causing less fog, and having excellent pressure resistance and processing properties.

BACKGROUND OF THE INVENTION

It is known in the field of photography that silver halide crystal grains are useful for forming latent images by irradiation with visible light, ultraviolet light, or radiations such as $\beta$-rays, neutron beams, and $\gamma$-rays, and further forming visible images by developing the latent images. As such silver halide grains, various silver halide crystal grains such as silver iodide, silver bromide, silver chloride, silver iodobromide, silver iodochloride, silver chlorobromide, silver iodochlorobromide, etc., are used. Also, with respect to the form of these silver halide crystal grains, regular grains such as cubic form, octahedral form, tetrahedral form, dodecahedral form, etc.; irregular crystal grains such as spherical form, tabular form, indefinite form, etc.; and crystal grains of multicomposed structure having stratiform structure or epitaxial structure (junction-type structure) in the grains are known. That the halogen composition, the form, or the structure of the grains largely influences various properties of silver halide grains is not only clear from the descriptions on the properties of silver halide in Chapter 1 and Chapter 'of T. H. James, *The Theory of the Photographic Process,* 4th Edition, (Macmillan Publishing Co., Inc., New York), and the description of the form of silver halide in Chapter 3 of ibid., but also is well known based on many sources to persons skilled in the art.

The halogen composition of silver halide emulsions, the form of silver halide grains, and the grain sizes or grain size distributions of silver halide grains are properly selected according to the use of the photographic material for which the silver halide emulsion is used and the performance imparted to the photographic material. However, silver halide grains sufficiently satisfying the desired performance are not always obtained, and hence it has been of great interest for persons skilled in the art to obtain silver halide emulsions sufficiently satisfying the desired performance.

For example, regarding the photographic performance, high sensitivity, the occurrence of less fog, excellent graininess, desired gradation, etc., have been desired; regarding the processing performance, quickness and stability have been desired; and further silver halide emulsions having excellent stability with the passage of time and pressure resistance have been expected.

In particular, in the field of color photographic light-sensitive materials, quickness and stability in processing, as well as toughness of photographic materials in handling thereof have been strongly desired. Thus, it is very useful to provide silver halide emulsions having excellent properties in these points.

Silver halide emulsions have various features according to the kind of the halogen. For example, a silver chloride emulsion is low in sensitivity but is excellent in developing speed and suitable for quick processing. Also, the silver chloride emulsion is liable to form fog. On the other hand, a silver bromide emulsion is somewhat slow in developing speed, for forms less fog and also has a high sensitivity. A silver iodide emulsion is very difficult to develop, and is almost never used alone, but mixed crystals of silver iodide and silver bromide are particularly important for photographic materials having an excellent light-sensitivity.

Various techniques of utilizing these features of the various kinds of silver halides are known. For example, there are many reports about stratiform structures using core-shell type silver halide grains. Typically, in such a silver halide, the whole surface of the core is coated with one or more other silver halides. Japanese Patent Publication No. 18,939/81 describes that a core-shell type silver halide emulsion composed of silver bromide as the core and silver chloride as the shell has a high light-sensitivity of silver bromide and a quick developability of silver chloride, but in a mixed crystal type silver chlorobromide emulsion, both advantageous functions are inhibited. Also, West German Patent Application (OLS) No. 3,229,999 discloses that core-shell type silver halide grains formed by disposing a silver halide layer having at least 25 mole% silver chloride adjacent to a silver halide layer having a less content of silver chloride than the former are less in fog formation and good in pressure resistance.

Various techniques are also known about silver halide crystal grains having a different structure form the core-shell structure. For example, U.S. Pat. No. 4,094,684 discloses an emulsion containing silver halide grains formed by epitaxially growing silver chloride onto polyhedral silver iodide. Similarly, U.S. Pat. No. 4,463,087 discloses an emulsion containing a silver salt epitaxially grown onto host silver halide grains containing silver iodide surrounded by (111) crystal faces and a process for producing the same; and U.S. Pat. No. 4,471,050 discloses an emulsion containing silver halide host grains of a face-centered cubic crystal structure and non-isomorphic salts which are grown only at the edges or corners of the host grains. Furthermore, Japanese Patent Publication No. 24,772/83 describes cubic silver halide crystals having a different halide composition between the corner portions and the principal portion and also discloses that it is possible to selectively introduce impurities and to control the formation of crystal defects.

In this respect, it is described that when silver chloride is deposited onto octahedral silver bromide crystals, many small silver chloride crystals having (100) planes are formed on the eight (111) faces of the octahedron, and when the deposition of silver chloride is further continued, they are united to form faces as a cube, in C. Hasse, H. Frieser, and E. Klein, *Die Grundlagen der Photographischen Prozesse mit Silberhalogeniden,* Vol. 2, (Akademische Verlagsgesellschaft, Frankfurt an Main, 1968).

Also, it is reported by C. R. Berrry and D. C. Skillman, *Journal of Applied Physics,* Vol. 35, No. 7, p. 2165 (1964) that the deposition of silver chloride onto octahedral silver bromide causes an epitaxial growth of silver chlorobromide mixed crystals on the (111) faces thereof, and that the deposition of silver chloride on cubic silver bromide shows an epitaxial growth only at the corners or edges of the cube.

In these known techniques or knowledges described above, a silver halide such as silver chloride is epitaxially grown selectively at the corners or edges of crystals of other silver halide (such as silver bromide) or is grown on the (111) faces of the crystals; or, in the above-described core-shell type silver halide grains, a silver halide is uniformly grown over the whole surface of a core silver halide grain. However, epitaxial junction-type silver halide grains having a silver halide selectively epitaxially joined to and grown on the (100) faces of other silver halide crystals have not yet been known.

SUMMARY OF THE INVENTION

A primary object of this invention is to provide a photographically useful silver halide emulsion having a novel crystal form.

Another object of this invention is to provide a silver halide photographic material having high sensitivity and low fog when spectrally sensitized, and showing excellent pressure resistance and processing properties by the use of the aforesaid silver halide emulsion having a novel crystal form.

As a result of extensive investigations, the inventors have discovered that the aforesaid objects can be attained by the present invention as set forth below.

That is, in one embodiment, the present invention is directed to a silver halide photographic emulsion comprising silver halide crystal grains composed of cubic, rectanguloid, or tetradecahedral silver halide crystals as a first type of silver halide crystal (hereinafter often referred to "a host crystal"), having projection-joined to at least one of the six (100) faces thereof a second type of silver halide crystal having a different halogen composition from that of the surface of the first type of silver halide crystal.

In another embodiment, the present invention is directed to a silver halide photographic material comprising a support having thereon at least one silver halide photographic emulsion layer containing silver halide crystal grains composed of cubic, rectanguloid, or tetradecahedral silver halide crystals as a first type of silver halide crystal having projection-joined to at least one of the six (100) faces thereof a second type of silver halide crystal having a different halogen composition from that of the surface of the first type of silver halide crystal.

BRIEF DESCRIPTION OF THE DRAWINGS

FIG. 1 shows the junction-type silver halide grains composed of a cubic host silver halide crystal having projection-joined to all of the (100) faces thereof a second type of silver halide crystal also surrounded by (100) faces (host crystal/crystal for junction=3/7). FIG. 2 shows the junction-type silver halide grains composed of the cubic host silver halide crystal having formed thereon a second type of silver halide crystal in the same molar amount as the host crystal (host crystal/projection-joined crystal=5/5). FIG. 3 shows another type of the junction-type silver halide grains, wherein the junction faces of the silver halide crystal for junction are grown without covering the whole surface of each (100) face of the host crystal (host crystal/projection-joined crystal=8/2).

FIG. 2 is defined as 1, it being seen that FIG. 4(*a*) coincides well with the actually observed form of FIG. 1; FIG. 4(*b*) coincides well with the actually observed form of FIG. 2; and numerical values being not shown on FIG. 4(*c*) since the dimensions of the projection-joined crystal are arbitrary.

DESCRIPTION OF PREFERRED EMBODIMENTS

Figure 1:
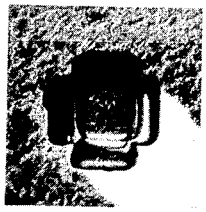
FIG. 1 to FIG. 3 are electron microscopic photographs of 30,000 times magnification, showing junction-type silver halide grains according to this invention.
Figure 2:
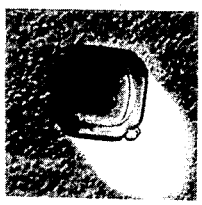
Figure 3:
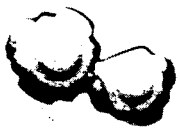
Figure 4A:
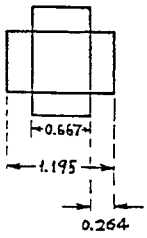
FIGS. 4(*a*), 4(*b*), and 4(*c*) each is a conceptional view of the grain form obtained from the ratio of host crystal/projection-joined crystal of the junction-type silver halide grains shown in FIG. 1, FIG. 2, and FIG. 3, respectively. The numeral values in FIGS. 4(*a*) and 4(*b*) each shows the relative value when the one side length of a cube which is supposedly made using all the silver amount used for making the junction-type silver halide grain shown in FIG. 1
Figure 4B:
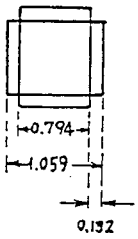
Figure 4C:
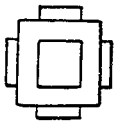

The junction-type silver halide grains for use in this invention are explained in more detail below.

In the most typical silver halide grains for use in this invention, the second type of silver halide crystal is projection-joined (hereinafter simply referred to "joined") to the six (100) faces of a cubic, rectanguloid, or tetradecahedral first type of silver halide crystal having a different halogen composition from that of the second type silver halide crystal, in the form of a cube or a rectangular parallelepiped, the outer surface of which is frequently surrounded by (100) faces. The joined second type of silver halide crystal is not limited strictly to a cube or rectangular parallelepiped shape, but also may be partially round or the (111) faces or (110) faces may be exposed. Also, the joined second type of crystals each formed on a different (100) face may be joined with each other to cover the edge(s) and/or the corner(s) of the first type of silver halide crystal. Furthermore, the second type of silver halide crystal to be joined is not always formed on all six (100) faces of the host first type of crystal, but may be formed 5 or 4 faces, or, as the case may be, even on only one (100) face thereof. In other words, in this invention, the second type of silver halide crystal having a different halogen composition from that of the host crystal may be formed on and joined to at least one (100) face of the host crystal, it is preferred that the second type of crystal is formed on two or more (100) faces of the host crystal, and it is most preferred that the second type of crystal is formed on all the (100) faces of the host crystal. The joined second type of silver halide crystal may cover the whole surface of each (100) face of the host crystals or may cover a part of the surface thereof. Also, as described above, the second type of silver halide crystals each joined to a different (100) face of the host crystal may be joined with each other. Moreover, the host crystal is most preferably a cubic crystal, a rectanguloid crystal, or a tetradecahedral crystal, but in this invention, the edges or the corners of the host crystal may be around, or, in other words, the host crystal may not have a distinct appearance of a cubic crystal, a rectanguloid crystal, or a tetradecahedral crystal if the crystal has (100) faces to which the second type of silver halide crystal can join. Accordingly, such silver halide grains are included in the silver halide grains for use in this invention.

The ratio of the silver halide forming the host crystal to the second type of silver halide crystal formed thereon to be joined thereto can be optionally selected, but if the proportion of the second type of silver halide crystal to the first type of silver halide crystal is too small, a clear junction structure is not obtained, whereas if the proportion of the second type of silver halide crystal to the first type of silver halide crystal is too large, the second type of silver halide crystal forms other grains without being wholly joined or completely covering all surfaces of the host crystal to form silver halide grains having a double layer structure. Accordingly, the molar ratio of the second type of silver halide crystal to the first type of silver halide crystal is preferably 0.03/1 to 12/1.

In order that the silver halide crystal to be joined is uniformly formed on the host crystal, it is preferred that not only is the form of the host crystal uniform, but also the mono-dispersibility is high due to a narrow grain size distribution. In contrast with this, if the host crystal has a wide grain size distribution, a silver halide emulsion having a different silver amount ratio of joined crystal/host crystal between both grains can be obtained by controlling the addition rates of a water-soluble silver salt and a water-soluble halide for forming the second type of silver halide crystal to be joined to the host crystal.

In this invention, it is preferred that the proportion of the silver halide grains for use in this invention having the joined second type of silver halide crystal formed on all six (100) faces of the host silver halide crystal is 40% or more based on the total silver halide grains formed in grain number or weight. Furthermore, it is preferred that the proportion of the silver halide grains for use in this invention having the joined second type of silver halide crystal formed on 4 or more (100) faces of the host crystal is 60% or more based on the total silver halide grains formed in grain number or weight. Moreover, it is preferred that the proportion of the silver halide grains having the joined crystal formed on 3 or more (100) faces of the host crystal is 85% or more based on the total silver halide grains formed in grain number or weight.

It is also preferred that the proportion of the silver halide grains for use in this invention having a structure such that the joined silver halide crystals formed on each different (100) face of the same host silver halide crystal are joined with each other over the edge portion(s) of the host crystal or are joined with each other so that they cover the corner portion(s) of the host crystal or the (111) faces of tetradecahedral host crystal is not over 80% of the total silver halide grains in grain number or weight, and in the case of covering the edge portion(s) of the host crystal, it is necessary that at least 6 corners of the 12 edge portions of one host crystal are not covered by the second type of silver halide crystal. Also, at least 4 corners of the 8 corners of the host crystal or 4 or more (111) faces of the 8(111) faces of the host crystal may be left without being covered by the second type of silver halide crystal.

When silver halide crystals are those having a multicomposed structure wherein all the edge portions and the corner portions of the host crystal are covered by a second type of silver halide crystal, the second crystal means a "non-projection-joined" crystal.

The halogen composition of the host crystal can be not silver iodide because it neither forms a host crystal nor joins, but silver iodobromide, silver bromide, silver chlorobromide, silver iodochlorobromide, etc. A silver iodobromide host crystal for use in this invention may contain up to 40 mole% of silver iodide. Also, silver chlorobromide for use in this invention can have an optional halogen composition of from 0 mole% or more but less than 100 mole% with respect to the silver chloride. In the case of silver iodochlorobromide, it is preferred that the content of silver iodide is 10 mole% or less. When the content of silver chloride is, in particular, more than 70 mole%, it is preferred that the content of silver iodide is 2 mole% or less.

The halogen composition of the joined second type of silver halide crystal can be silver iodobromide, silver bromide, silver chlorobromide, silver iodochlorobromide, or silver chloride, but it is preferred that the content of silver iodide in the silver iodobromide is 4 mole% or less. While the silver chlorobromide is preferred as the second type of silver halide crystal, in the case that the silver iodide is present, it is preferred that its content is 2 mole% or less.

In the preparation of the junction-type grains, the host silver halide crystals are first prepared. The cubic host grains, rectanguloid host grains, or tetradecahedral host grains are prepared by adding an aqueous solution of a soluble silver salt and an aqueous solution of a soluble halide under a condition of a definite silver ion concentration. When the content of silver chloride is high, the host grains may be formed without keeping the silver ion concentration definite. Also, the host silver halide grains may be formed by the method as described by E. Moisar and E. Klein in *The report of Physiochemical Bunsen Association,* Vol. 67, (1963). The host grains may be of a so-called double layer structure type that the halogen composition of the inside or core portion differs from that of the surface portion or of other structure type, if the surface portion or the shell portion of the host grain has the above-described halogen composition.

The formation of the joined second type of silver halide crystals is performed, in succession to the formation of the host silver halide crystals described above, by adding thereto an aqueous solution of soluble halide(s) having a different halogen composition from that of the host silver halide crystals, and an aqueous solution of a soluble silver salt. In this case, it is preferred to maintain the silver ion concentration definite, but in the case of forming silver chlorobromide, homogeneous joined silver halide grains can be, as the case may be, formed without keeping a definite silver ion concentration, and in particular, when the content of silver chloride in the joined second type silver chlorobromide crystals is high, the joined second type crystals can be formed by adding an aqueous solution of halides to a suspension of the host silver halide crystals and thereafter adding thereto an aqueous solution of a silver salt. Furthermore, the joined end silver halide crystals can be formed by separately preparing the second type of silver halide crystals and the host silver halide crystals and mixing these two kinds of silver halide crystals followed by physical ripening.

When an aqueous solution of the second type of halide(s) and an aqueous solution of a silver salt for forming the joined second type of silver halide crystals are added to the host silver halide crystals at the maximum addition rate in the rate of not forming new nucleu, the joined silver halide crystals formed have a halogen composition near the composition of the aqueous halide(s) solution added and the composition of the host silver halide crystals keeps almost the initial composition thereof. However, when the above-described addition condition is changed or after keeping the crystal growing condition described above, the crystals are subjected to physical ripening, the aqueous solution of the second type of halide(s) added or the second type of crystals formed cause recrystallization with the host silver halide crystals, or, as the case may be, cause a halogen conversion, whereby the halogen composition of the joined end crystals formed becomes different from the halogen composition of the aqueous second type halide(s) solution added, and hence the composition itself of the host silver halide crystals sometimes becomes different from the initial composition of the host crystal. In this case, the constitution molar ratio of the host silver halide crystals to the joined second type of silver halide crystals sometimes differs.

The halogen composition change of the host crystals and joined crystals by the recrystallization as described above or the change of the constitution molar ratio of the host crystals to the joined crystal are particularly remarkable in the case of using silver chlorobromide for one or both types of crystals. Even these silver halide grains which caused such changes can realize the effect of this invention if the joined silver halide crystals formed had the form of the initial joined crystals.

If the halogen composition of the halide(s) forming the second type of silver halide crystals is the same as the halogen composition of the host crystals, the joined silver halide grains according to this invention are not formed and silver halide grains having a stratiform structure or a core/shell structure grow. In other words, it is necessary according to this invention that the halogen composition of the host silver halide crystals differs from that of the second type of silver halide crystals. Also, since in the junction type silver halide grains for use in this invention, the halogen composition differs between the host crystal portion and the joined crystal portion, it may be possible that recrystallization occurs during the formation of crystal grains and thus the joined crystals formed are dissolved off or are incorporated in the host crystal, whereby the joined crystals nominally disappear to give no form of junction-type grains. Such silver halide grains are outside the scope of this invention, and it is considered that whether or not such silver halide grains form depends upon the joined crystals growth rate during the formation of the second type of silver halide crystals and the vanishing rate of the joined crystals by recrystallization or Ostwald ripening. That is, if the former rate is higher than the latter rate, the ripened second type of silver halide crystals are formed, whereas if the latter rate is higher than the former rate, the joined crystals are not formed. It is considered that the preparation method for forming the junction-type silver halide grains for use in this invention is required to simultaneously satisfy the three conditions that (1) the host crystals have the (100), (2) the halogen composition of the host silver halide crystals differs from that of the second type of silver halide crystals which contributes to the formation of the junction-type silver halide crystals, and (3) the joined crystal growth rate during the formation of the second type of silver halide crystals is higher than the vanishing rate of the joined crystals by recrystallization or Ostwald ripening. In other words, for obtaining the junction-type silver halide grains for use in this invention, other specific conditions are not required if the aforesaid requirements are satisfied.

Techniques for the formation of the above-described junction-type silver halide grains have not yet been reported until now since the preparation method for silver halide grains satisfying the aforesaid three conditions has not yet been established. In particular, the factor for the preparation of silver halide grains satisfying condition (3) is not always easy. In general, it is helpful for satisfying condition (3) to increasing the addition rates of the second type of silver halide(s) and the silver salt to approach the crystal growing condition of reducing the temperature to make the Ostwald ripening, etc., sparingly occur, but it is better for easily obtaining the formation of the junction-type silver halide grains to not control recrystallization. That is, simply, if the site of recrystallization when the silver halide crystals are dissolved and recrystallized is any part of the joined silver halide crystals, the formation of the junction-type silver halide grains for use in this invention is accelerated, and on the contrary, if the site of recrystallization is a non-joined part of the host crystals, the formation of the junction-type silver halide grains is restricted.

In the formation of the junction-type silver halide grains for use in this invention, the existence of some compounds capable of absorbing silver halide crystals is not always necessary, but they sometimes function advantageously. The inventors have discovered nucleic acid decomposition products and substituted or unsubstituted phenylmercaptotetrazoles as such compounds. In the formation of the grains according to the present invention, these compounds may be added, or other compounds having a similar function may be added. It is considered that not only these compounds inhibit the occurrence of the aforesaid recrystallization or Ostwald ripening but also the selective adsorption onto the (110) faces accelerate the formation of the junction-type silver halide grains for use in this invention.

It sometimes happens that the silver halide adsorbing compound present during the formation of the junction-type silver halide grains impedes the formation of the junction-type silver halide grains. If many of cyanine dyes exist during the formation of the second type of silver halide crystals, they frequently impede the formation of the junction-type silver halide grains and form a cubic or rectanguloid appearance of silver halide grains formed. However, such a compound having an impeding action is effective for stably keeping the form of the junction-type silver halide grains already formed. Since the junction-type silver halide grains for use in this invention are liable to change the form thereof by recrystallization etc., even after the formation of the grains according to the conditions during the formation of the junction-type grains as well as the temperature, pAg, etc., it is sometimes preferred to add some silver halide adsorptive compound as described above.

In this invention, it is also possible to change the junction form of the joined grains and the halogen distribution in the grains.

Also, junction-type silver halide grains having joined third type silver halide grains further formed on the joined second type silver halide grains can be formed.

Additives which can be used in the case of producing silver halide emulsions according to this invention are described below.

For controlling the growth of the silver halide grains for use in this invention during the formation of the silver halide grains, a silver halide solvent such as ammonia, potassium thiocyanate, ammonium thiocyanate, thioether compounds (as described, e.g., in U.S. Pat. Nos. 3,271,157, 3,574,628, 3,704,130, 4,297,439, 4,276,374, etc.), thion compounds (as described, e.g., in Japanese Patent Application (OPI) Nos. 144,319/78, 82,408/78, 77,737/80, etc.), amine compounds (as described, e.g., in Japanese Patent Application (OPI) No. 100,717/79, etc.), etc., can be used. The term "OPI" as used herein refers to a "published unexamined Japanese patent application".

The silver halide grains may be formed or physically ripened in the existence of a cadmium salt, a zinc salt, a thalium salt, an iridium salt or a complex salt thereof, a rhodium salt or a complex salt thereof, an iron salt or a complex salt thereof, etc., to thereby improve the reciprocity law failure.

The silver halide emulsions for use in this invention are usually chemically sensitized. For the chemical sensitization, the methods described, e.g., in H. Frieser et al, *Grundlagen der Photographischen Prozesse mit Silverhalogeniden,* Vol. 2, pages 675–734 (1968) can be used.

That is, there are a sulfur sensitization method using active gelatin or a sulfur-containing compound capable of reacting with silver (e.g., thiosulfates, thioureas, mercapto compounds, rhodanines, etc.); a reduction sensitizing method using reducing materials (e.g., stannous salts, amines, hydrazine derivatives, formamidinesulfinic acid, silane compounds, etc.); a noble metal sensitizing method using noble metal compounds (e.g., gold complex salts and complex salts of metals belonging to group VIII of the periodic table, such as Pt, IR, Pd, etc.), etc. and these methods can be used individually or as a combination thereof.

The silver halide photographic emulsions for use in this invention may contain various compounds for preventing the formation of fog during the production, preservation, and photographic processing of the photographic materials or for stabilizing the photographic properties thereof. Examples of these compounds are known antifoggants or stabilizers such as azoles such as benzothiazolium salts, nitroindazoles, triazoles, benzotriazoles benzimidazoles (in particular, nitro- or halogen-substituted products), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines, etc.; the above-described heterocyclic mercapto compounds having a water-soluble group such as a carboxyl group or a sulfone group; thioketo compounds such as oxazolinethion, etc.; azaindenes such as tetrazaindenes (in particular, 4-hydroxy-substituted (1,3,3a,7)tetrazaindenes), etc.; benzenethiosulfonic acids; benzenesulfinic acids, etc.

The silver halide photographic emulsions for use in this invention can contain color couplers such as cyan couplers, magenta couplers, yellow couplers, etc., and compounds for dispersing the couplers.

That is, the silver halide emulsions may contain compounds capable of coloring by the oxidative coupling with an aromatic primary amine developing agent (e.g., phenylenediamine derivatives, aminophenol derivatives, etc.) at color development. Examples of the magenta couplers include 5-pyrazolone couplers, pyrazolobenzimidazole couplers, cyanoacetylcoumarone couplers, open chain acylacetonitrile couplers, etc. Examples of the yellow couplers include acylacetamide couplers (e.g., benzoylacetanilides, pivaloylacetanilides, etc.), etc. Examples of the cyan couplers include naphthol couplers, phenol couplers, etc. It is preferred that these couplers are non-diffusible couplers having a hydrophobic group referred to as a ballast group in the molecule. The couplers may be four equivalent or two equivalent with respect to silver ion. Also, these couplers may be colored couplers having a color correction effect or so-called DIR couplers capable of releasing a development inhibitor. Also, in place of DIR couplers, non-coloring DIR coupling compounds capable of forming of colorless coupling reaction product and releasing a development inhibitor.

The silver halide photographic emulsions for use in this invention may further contain polyalkylene oxides or derivatives thereof (e.g., ethers, esters, amines, etc.), thioether compounds, thiomorpholines, quaternary ammonium salt compounds, urethane compounds, urea derivatives, imidazole derivatives, 3-pyrazolidones, etc.

The silver halide photographic emulsions for use in this invention may further contain water-soluble dyes (e.g., oxonol dyes, hemioxonol dyes, merocyanine dyes, etc.) as filter dyes or for irradiation prevention or other various purposes. Also, the silver halide emulsions may further contain cyanine dyes, merocyanine dyes, hemicyanine dyes, etc., before, during, or after chemical sensitization as spectral sensitizers or for controlling the crystal forms and sizes of silver halide grains formed.

The silver halide photographic emulsions for use in this invention may further contain coating aids and various surface active agents for preventing the static electrification, improving the slidability of the photographic materials, improving the dispersibility of the emulsions, preventing the adhesive property of the photographic materials, and improvement of photographic properties (e.g., development acceleration, increase of contrast, sensitization, etc.).

The photographic materials of this invention may contain various additives such as fading preventing agents, hardeners, color fogging preventing agents, ultraviolet light absorbents, etc., and protective colloids such as gelatin, etc. Such are described in *Research Disclosure,* Vol. 176, (December, 1978), RD-17643, etc.

The finished silver halide emulsion described above is coated on a proper support such as a baryta-coated paper, a resin-coated paper, a synthetic paper, a triacetate film, a polyethylene terephthalate film, other plastic base, a glass sheet, etc.

The silver halide photographic material of this invention can be applied to color photographic positive films, color photographic papers, color photographic negative films, color reversal films (containing or not containing couplers), photomechanical light-sensitive materials (e.g., lithographic films, lithographic duplicating films, etc.), light-sensitive materials for cathode ray tube display, light-sensitive materials for X-ray recording, light-sensitive materials for silver salt diffusion transfer process, light-sensitive materials for color diffusion transfer process, light-sensitive materials for inhibition transfer process, silver halide photographic emulsions for silver dye bleach process, light-sensitive materials for recording the print-out image, light-sensitive materials for direct print image, heat-developable light-sensitive materials, light-sensitive materials for physical development, etc.

The exposure for obtaining photographic images using the silver halide photographic materials of this invention may be performed using an ordinary method. That is, various light sources such as natural light (sunlight), a tungsten lamp, a fluorescent lamp, a mercury vapor lamp, a xenon arc lamp, a carbon arc lamp, a xenon flash lamp, a cathode ray tube flying spot, etc. The exposure time may be, as a matter of course, form 1/1000 second to 1 second or may be shorter than 1/1000 second, for example $1/10^4$ to $1/10^6$ second in the case of using a xenon flash lamp or a cathode ray tube or may be longer than 1 second. If desired, the spectral composition of light which is used for exposure can be controlled using color filters. Also, laser light can be used for the exposure of the photographic materials of this invention. Furthermore, the photographic materials may be exposed by light emitted from a phosphor excited by electron beams, X-rays, $\gamma$-rays, $\alpha$-rays, etc.

For photographic processing of the materials of this invention can be applied the processes and processing solutions as described in *Research Disclosure,* Vol. 176, pages 28–30 (December, 1978) (RD-17643). The photographic processing may be one for forming silver image (black-and-white photographic processing) or one for forming dye images (color photographic processing). The processing temperature is usually selected from the range of from 18° C. to 50° C., but may be lower than 18° C. or higher than 50° C.

The following examples are provided to further illustrate the present invention, but the present invention is not limited thereto.

EXAMPLE 1

After dissolving 40 g of lime-processed gelatin in 1,400 ml of distilled water at 40° C., the temperature was raised to 70° C. and an aqueous solution of 100 g of silver nitrate dissolved in 800 ml of distilled water and an aqueous solution of 80 g of potassium bromide dissolved in 600 ml of distilled water were added thereto while keeping the potential at +120 mV until the aqueous silver nitrate solution had disappeared to provide cubic silver bromide grains having a mean grain size of 0.4 μm as host crystals. To the emulsion containing the host crystals were further added an aqueous solution of 50 g of silver nitrate dissolved in 400 ml of distilled water and an aqueous solution of 28 g of potassium bromide and 3.7 g of sodium chloride dissolved in 400 ml of distilled water over a period of 20 minutes. When the crystal grains of the silver halide emulsion thus obtained were observed by an electron microscope, the formation of joined crystals on the (100) faces of the cubic silver halide grains was confirmed. This silver halide emulsion is referred to as Emulsion A.

EXAMPLE 2

After dissolving 30 g of lime-processed gelatin in 1,000 ml of distilled water at 40° C. and adjusting the pH of the solution to 4.0 by sulfuric acid, 6.5 g of sodium chloride and 0.02 g of N,N'-dimethylethylenethiourea were dissolved therein and then the temperature of the solution was raised to 65° C. Thereafter, an aqueous solution of 62.5 g of silver nitrate dissolved in 750 ml of distilled water and an aqueous solution of 30.6 g of potassium bromide and 6.5 g of sodium chloride dissolved in 500 ml of distilled water were added to the aforesaid solution while maintaining the temperature thereof at 65° C. over a period of 40 minutes. By the observation of the silver halide grains thus formed by an electron microscope, the formation of cubic silver halide grains having a mean side length of 0.36 μm was confirmed. To the emulsion containing the host silver halide crystals thus obtained were further added an aqueous solution of 62.5 g of silver nitrate dissolved in 500 ml of distilled water and an aqueous solution of 13.1 g of potassium bromide and 15.1 g of sodium chloride dissolved in 300 ml of distilled water while maintaining the mixture at 60° C. over a period of 20 minutes. When the silver halide grains thus formed were observed by an electron microscope, the formation of joined silver halide crystals on the (100) faces of the host silver halide crystals was confirmed. Many rectanguloid joined silver halide crystals having a thickness of about 0.12 μm and a joined face area of about 0.30 μm square were observed. This silver halide emulsion is referred to as Emulsion B.

When Emulsion B was further ripened for 20 minutes at 60° C., joined silver halide grains were not observed and cubic silver halide grains having a side length of about 0.45 μm were observed. This emulsion is referred to as Emulsion C.

EXAMPLE 3

To the emulsion containing the host silver halide crystals as in Example 2 were added an aqueous silver nitrate solution and an aqueous halides solution as used in Example 2 for forming joined crystals at 40° C. for a period of 10 minutes. When the silver halide grains thus formed were observed by an electron microscope, joined silver halide grains formed on the (100) faces of the cubic host crystals were observed. The joined silver halide crystals were rectanguloid crystals having a thickness of about 0.06 μm and a joined face area of about 0.35 μm square. This emulsion is referred to as Emulsion D.

EXAMPLE 4

After dissolving 20 g of lime-processed gelatin in 1,000 ml of distilled water under heating at 70° C., 1.3 g of sodium chloride and 0.04 g of N,N'-dimethylethylenethiourea were added to the solution followed by maintaining the temperature thereof at 70° C., and an aqqueous solution of 100 g of silver nitrate dissolved in 800 ml of distilled water and an aqueous solution of a mixed halide of 68.6 g of potassium bromide and 2 g of potassium iodide dissolved in 800 ml of distilled water were simultaneously added thereto followed by stirring. The silver halide grains of the emulsion thus obtained were of a tetradecahedral crystal form formed by slightly chipping the corners of a cube. To the silver halide emulsion containing the host crystals were further simultaneously added an aqueous solution of 25 g of silver nitrate dissolved in 200 ml of distilled water and an aqueous solution of 8.8 g of potassium bromide and 4.3 g of sodium chloride dissolved in 200 ml of distilled water over a period of 3 minutes.

By observation using an electron microscope, the formation of joined silver halide crystals one the (100) faces of the tetradecahedral host silver iodobromide crystals was confirmed. In this case, the formation of joined silver halide crystals which were considered to have (100) faces was also observed on the (111) faces of the host crystals. This emulsion is referred to as Emulsion E.

EXAMPLE 5

To 1,000 ml of distilled water was added 30 g of lime-processed gelatin and then the gelatin was dissolved therein at 40° C. together with 5.5 g of sodium chloride. Then, after adjusting the pH of the solution to 4.0 with sulfuric acid, an aqueous solution of 62.5 g of silver nitrate dissolved in 750 ml of distilled water and an aqueous solution of 21.5 g of sodium chloride dissolved in 500 ml of distilled water were simultaneously added to the aforesaid solution while maintaining the temperature at 54° C. over a period of 60 minutes followed by stirring. Then, 500 ml of the silver halide emulsion thus obtained was mixed with 500 ml of the host silver halide crystal-containing emulsion prepared in Example 2 and the mixture was stirred for 30 minutes at 40° C. and allowed to stand, during which the change of the silver halide grains was observed. Immediately after mixing, cubic silver chlorobromide grains having a side length of 0.36 μm and cubic silver chloride grains having a side length of 0.40 μm, that is, two kinds of the mixed silver halide grains, were observed. However, after being allowed to stand for 30 minutes, joined crystals of a rectanguloid form having a thickness of 0.08 μm were observed on the (100) faces of cubic crystals in the mixed emulsion. On the other hand, cubic grains having no joined crystals were also observed at the same time. It is considered that the grains having the joined crystals are cubic silver chlorobromide grains on which silver chloride grains once dissolved are recrystallized and the cubic grains having, in appearance, no joined crystals are the grains formed by silver chlorobromide grains once dissolved are recrystallized oncubic silver chloride grains.

EXAMPLE 6

A host crystal-containing emulsion was prepared by the same manner as in Example 2. Furthermore, before forming joined grains thereon, 0.005 g of 1-(m-methylureidophenyl)-5-mercaptotetrazole was added to the emulsion and then an aqueous silver nitrate solution and an aqueous halide solution were added as in Example 2 to form joined silver halide crystals. The grains thus obtained showed more clearly joined crystals then Emulsion B in Example 2. Also, under the conditions of forming Emulsion C form Emulsion B in Example 2, the silver halide grains in this example scarcely changed.

EXAMPLE 7

A host crystal-containing emulsion was prepared in the same manner as Example 2. Furthermore, before forming joined grains thereon, 0.012 g of anhydro-3,3'-disulfoethyl-5,5'-diphenyl-9-ethyloxacarbocyanine hydroxide was added to the emulsion and then an aqueous silver nitrate solution and an aqueous halide solution were added thereto as in Example 2 to form joined crystals. In the grains thus obtained, the growth of the joined crystals was insufficient as compared with Emulsion B in Example 2, but it was observed that the edges and the corners of the crystals were sharp without being rounded too much.

EXAMPLE 8

Figure 5:
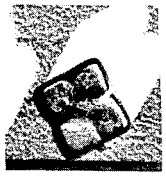
FIG. 5 is an electron microscopic photograph of 30,000 times magnification, showing a junction-type cubic silver halide crystal grain having cross-shaped grooves on the (100) faces thereof, which is outside the scope of this invention.
Figure 6A:
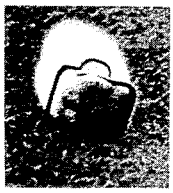
FIGS. 6(*a*), 6(*b*), and 6(*c*) each is an electron microscopic photograph of 30,000 times magnification, showing an example of the junction-type silver halide grain according to this invention having silver halide crystals for junction not on all the six (100) faces, but rather on one or a few (100) faces of the cube.
Figure 6B:
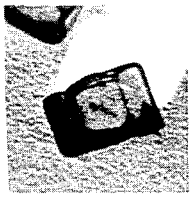
Figure 6C:
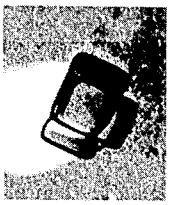
Figure 7A:
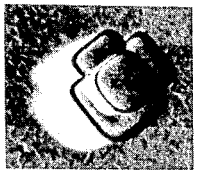
FIGS. 7(*a*) and 7(*b*) each is an electron microscopic photograph of 30,000 times magnification, showing an example of the junction-type silver halide crystal grain having a portion that silver halide crystals for junction formed on each different (100) face of the cube are brought into contact with each other to form a junction with each other.
Figure 7B:
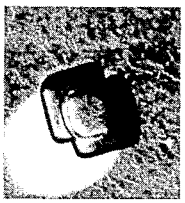
Figure 8:
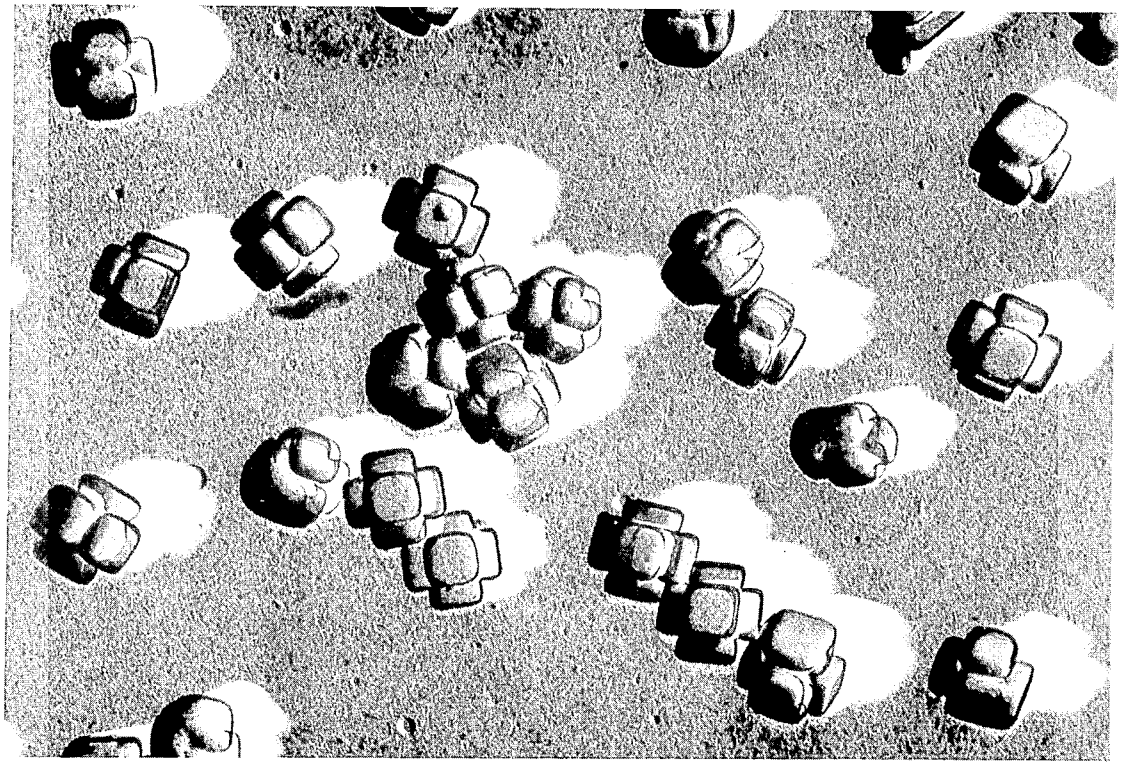
FIG. 8 is an electron microscopic photograph of 30,000 times magnification, showing Emulsion B prepared in Example 2.

After dissolving 25 g of lime-processed gelatin in 1,000 ml of distilled water at 40° C. and adjusting the pH thereof to 4.0, 5.5 g of sodium chloride was dissolved therein and then the temperature was raised to 65° C. Then, an aqueous solution of 62.5 g of silver nitrate dissolved in 750 ml of distilled water and an aqueous solution of 30.6 g of potassium bromide and 6.5 g of sodium chloride dissolved in 500 ml of distilled water were added to the aforesaid solution while maintaining the temperature at 65° C. over a period of 40 minutes. When the silver halide grains thus formed were observed by an electron microscope, it was confirmed that tetradecahedral crystals having a mean grain size of about 0.31 μm were formed. The emulsion containing the host silver halide crystals was split into two portions and 0.6 g of a nucleic acid decomposition product was added to one of the split emulsions. Then, to each of the split emulsions were added an aqueous solution of 62.5 g of silver nitrate dissolved in 500 ml of distilled water and an aqueous solution of 13.1 g of potassium bromide and 15.1 g of sodium chloride dissolved in 300 ml of distilled water over a period of 20 minutes. When the silver halide grains thus formed were observed by an electron microscope, the growth of joined crystals on the (100) faces of the host crystals was remarkably observed in the emulsion containing the nucleic acid decomposition product. On the other hand, in the silver halide emulsion containing no nucleic acid decomposition product, while the growth of joined crystals was scarcely observed on the (100) faces of the host crystals, joined crystals were grown on the (111) faces of the host crystals and finally, joined cubic crystals having cross-shaped grooves different from the joined crystals in this invention were formed on the (100) faces of the host crystals, as shown in FIG. 5 which is an electron microscopic photograph of 30,000 times magnification.

EXAMPLE 9

A comparison silver halide emulsion was prepared to Emulsion A in Example 1. After dissolving 40 g of lime-processed gelatin in 1,400 ml of distilled water at 40° C., the temperature thereof was raised to 70° C. and an aqueous solution of 150 g of silver nitrate dissolved in 1,200 ml of distilled water an an aqueous solution of 98 g of potassium bromide and 3.4 g of sodium chloride dissolved in 850 ml of distilled water were added to the solution while controlling the potential thereof at +180 mV using an aqueous solution of 0.3 g of sodium chloride dissolved in 75 ml of distilled water to provide an emulsion containing cubic silver chlorobromide grains having a mean size of 0.46 μm. The emulsion is referred to as Emulsion R.

Each of Emulsion A prepared as in Example 1 and Emulsion R was subjected to desalting, washing with water, and chemical sensitization by the addition of sodium thiosulfate and sodium chloroaurate. Each of the silver halide emulsions was coated on a cellulose triacetate support at a silver coverage of 3.5 g/m$^2$ and a gelatin coverage of 5 g/m$^2$ to provide Sample (a) and Sample (r). Each of the samples was exposed through a continuous wedge to white light of 5,400° K. for one second and then developed using an aminophenol-absorbic acid developer having the composition shown below for 10 minutes at 20° C. The density of each image obtained was measured and the results are shown in Table 1 below.

| Composition of Aminophenol-Ascorbic Acid Developer | |
|---|---|
| Ascorbic acid | 10 g |
| p-Methylaminophenol | 2.4 g |
| Sodium carbonate | 10 g |
| Potassium bromide | 1 g |
| Water to make | 1 liter |

TABLE 1

| Sample | Sensitivity | Fog |
|---|---|---|
| (a) This Invention | 145 | 0.02 |
| (r) Comparison Example | 100 | 0.02 |

From the above results, it can be see that Sample (a) using the silver halide emulsion according to this invention shows a higher sensitivity than that of the comparison sample with the same fog as that of the latter. In Table 1, the sensitivity of Sample (a) is shown by a relative value when the reciprocal of the exposure amount giving for +0.15 or Sample (r) is defined as 100.

EXAMPLE 10

A color photographic light-sensitive material (Sample (b)) was prepared by successively coating the first layer (lowermost layer) to the seventh layer (uppermost layer) on a paper support both surfaces of which were coated with polyethylene.

| | Coverage |
|---|---|
| Layer 1 (Blue-Sensitive Layer) | |
| Silver chlorobromide emulsion (silver bromide 80 mole %) | 400 mg/m$^2$ as Ag |
| Yellow coupler (*6-1) | 75 mg/m$^2$ |
| Yellow coupler (*6-2) | 85 mg/m$^2$ |
| Yellow coupler (*6-3) | 190 mg/m$^2$ |
| Coupler solvent (*7) | 150 mg/m$^2$ |
| Gelatin | 1,200 mg/m$^2$ |
| Layer 2 (Interlayer) | |
| Gelatin | 1,000 mg/m$^2$ |
| Layer 3 (Green-Sensitive Layer) | |
| Emulsion $B_1$ | 200 mg/m$^2$ as Ag |
| Magenta coupler (*4-1) | 75 mg/m$^2$ |
| Magenta coupler (*4-2) | 50 mg/m$^2$ |
| Magenta coupler (*4-3) | 100 mg/m$^2$ |
| Coupler solvent (*5) | 200 mg/m$^2$ |
| Gelatin | 1,000 mg/m$^2$ |
| Layer 4 (Interlayer) | |
| Ultraviolet light absorbent (*1) | 600 mg/m$^2$ |
| Ultraviolet light absorbent (*2) | 300 mg/m$^2$ |
| Gelatin | 800 mg/m$^2$ |
| Layer 5 (Red-Sensitive Layer) | |
| Silver chlorobromide emulsion (silver bromide 50 mole %) | 300 mg/m$^2$ as Ag |
| Spectral sensitizing dye (*8) | 0.04 mg/m$^2$ |
| Cyan coupler (*3-1) | 100 mg/m$^2$ |
| Cyan coupler (*3-2) | 100 mg/m$^2$ |
| Cyan coupler (*3-3) | 250 mg/m$^2$ |
| Coupler solvent (*2) | 400 mg/m$^2$ |
| Gelatin | 1,000 mg/m$^2$ |
| Layer 6 (Ultraviolet Light Absorptive Layer) | |
| Ultraviolet light absorbent (*1) | 600 mg/m$^2$ |
| Ultraviolet light absorbent (*2) | 300 mg/m$^2$ |
| Gelatin | 800 mg/m$^2$ |

-continued

| | Coverage |
|---|---|
| Layer 7 (Protective Layer) | |
| Gelatin | 1,000 mg/m$^2$ |

In addition, Emulsion $B_1$ used for Layer 3 above was prepared as follows.

To Emulsion B prepared in Example 2 was added 0.012 g of anhydro-3,3'-disulfoethyl-5,5'-diphenyl-9-ethyloxacarbocyanine hydroxide followed by stirring for 10 minutes, and after desalting and washing with water, the mixture was chemically sensitized with the addition of sodium thiosulfate. Thereafter, 4-hydroxy-6-methyl-(1,3,3a,7)-tetrazaindene and gelatin were added to the mixture to provide Emulsion $B_1$.

By following the same manner as the case of preparing Sample (a) using Emulsion $C_1$ prepared as described below in place of Emulsion $B_1$, Sample (c) was prepared. Emulsion $C_1$ was prepared as follows.

To Emulsion C prepared as in Example 2 was added 0.012 g of anhydro-3,3'-disulfoethyl-5,5'-diphenyl-9-ethyl-oxacarbocyanine hydroxide followed by stirring for 10 minutes and after desalting and washing with water, the emulsion was chemically sensitized with the addition of sodium thiosulfate. Thereafter, 4-hydroxy-6-methyl-(1,3,3a,7)-tetrazaindene and gelatin were added thereto to provide Emulsion $C_1$.

Each of Samples (b) and (c) was exposed to green light through a continuous wedge, processed by the processing steps as shown below, and the densities were measured.

| Processing Steps (33° C.) | |
|---|---|
| Color development | 3 min. 30 sec. |
| Blix (bleach-fix) | 1 min. 30 sec. |
| Wash | 3 min. |
| Drying | 10 min. |

The compositions of the processing solutions used for the above steps are as follows.

| | |
|---|---|
| Color Developer | |
| Benzyl alcohol | 15 ml |
| Diethylene glycol | 5 ml |
| Potassium carbonate | 25 g |
| Sodium chloride | 0.1 g |
| Sodium bromide | 0.5 g |
| Anhydrous sodium sulfite | 1.7 g |
| Hydroxylamine sulfate | 2 g |
| N—ethyl-N—β-methanesulfonamido-ethyl-3-methyl-4-aminoaniline sulfate | 4 g |
| Water to make | 1 liter |
| pH adjusted to 10 with NaOH | |
| Blix Solution | |
| Ammonium thiosulfate | 124.5 g |
| Sodium metahydrogensulfite | 13.3 g |
| Anhydrous sodium sulfite | 2.7 g |
| Ethylenediaminetetraacetic acid ferric ammonium salt | 65 g |
| Water to make | 1 liter |
| pH adjusted to 6.8 | |

In addition, the compounds used for preparing the above samples were as follows:

(*1): Ultraviolet light absorbent: 2-(2-Hydroxy-3-secbutyl-5-tert-butylphenyl)benzotriazole.

(*2): Solvent: Dibutyl phthalate.

(*3-1): Coupler: 2-[α-(2,4-Di-tert-pentylphenoxy)-butaneamido]-4,6-dichloro-5-methylphenol.

(*3-2): Coupler: 2-[α-(2,4-Di-tert-penthylphenoxy)-butaneamido[-4,6-dichloro-5-ethylphenol.

(*3-3): Couper: 2-(2-Chlorobenzamido)-5-[2-(4-tert-pentyl-2-chlorophenoxy)octaneamido]-4-chlorophenol.

(*4-1): Coupler: 1-(2,4,6-Trichlorophenyl)-3-(2-chloro-5-tetradecaneamido)anilino-4-(2-butoxy-5-tert-octylphenylthio)-2-pyrazolion-5-one.

(*4-2): Coupler: 1-(2,4,6-Trichlorophenyl)-3-(2-chloro-5-tetradecaneamido)anilino-2-pyrazolin-5-one.

(*4-3): Coupler: 2-(2-Octyloxy-5-tert-octylphenylsulfoneamidoethyl)-6-methyl-7-chloropyrazolo[1,5-b][1,2,4]triazole.

(*5): Solvent: Tricresyl phosphate.

(*6-1): Coupler: α-Pivaloyl- -(2,4-dioxy-5,5'-dimethyloxazolidin-3-yl)-2-chloro-5-[α-(2,4-di-tert-pentylphenoxy)butaneamido]acetanilde.

(*6-2): Coupler: α-Pivaloyl-α-(1-benzyl-5-ethoxyhydantoin-3-yl)-2-chloro-5-[α-(2,4-di-tert-pentylphenoxy)butaneamido]acetanilide.

(*6-3): Coupler: α-Pivaloyl-α-[3-(4-hydroxy-5-chlorobenzenesulfonyl)-2-chlorophenoxy]-2-chloro-5-[α-(2,4-di-tert-pentylphenoxy)-butaneamido]acetanilide.

(*7): Solvent: Dioctylbutyl phosphate.

(*8): Sensitizing dye: Anhydro-3-sulfobutyl-3'-phenethyl-5-methyl-6,6'-dimethyl-10-methylthiadicarbocyanine hydroxide.

The results thus obtained are shown in Table 2 below.

TABLE 2

| Sample | Sensitivity | Fog | Developing Speed | Pressure Resistance |
|---|---|---|---|---|
| Sample (b) | 100 | 0.02 | 0.07 | 0.05 |
| Sample (c) | 82 | 0.03 | 0.12 | 0.16 |

Sample (b): Sample of this invention
Sample (c): Comparison sample

In the above table, the sensitivity is shown by the same manner as in Example 9 with the sensitivity of Sample (b) as a standard, wherein, however, the exposure amount is for fog +0.5. Also, the developing speed in Table 2 is the difference in sensitivity between the case of setting the color development time in the above-described processing steps to 3 minutes and 30 seconds and the case of setting the color development time to 2 minutes, shown by the difference in the logarithms of the exposure amounts. The lower the numeral value is, the better the develping speed is. Furthermore, the pressure resistance shows the reduction in density at the sensitive point when each sample is bent at an angle of 60° before exposure. The smaller the numeral value, the better the pressure resistance is.

From the results shown in Table 2 above, it can be seen that Sample (b) of this invention is excellent in sensitivity, formation of fog, developing speed and pressure resistance as compared with Sample (c).

EXAMPLE 11

After dissolving 30 g of lime-processed gelatin in 1,000 ml of distilled water at 40° C. and adjusting the pH of the solution to 4.0 by sulfuric acid, 5.5 g of sodium chloride and 0.02 g of N,N'-dimethylethylenethiourea were dissolved therein and then the temperature of the solution was raised to 60° C. Thereafter, an aqueous solution of 62.5 g of silver nitrate dissolved in 750 ml of distilled water and an aqueous solution of 13.1 g of potassium bromide and 15.1 g of sodium chloride dissolved in 500 ml of distilled water were added to the aforesaid solution while maintaining the temperature thereof at 60° C. over a period of 40 minutes. To the emulsion containing the host silver halide crystals thus obtained were added 0.08 g of 1-(m-methylureidophenyl)-5-mercaptotetrazole and further an aqueous solution of 20.8 g of silver nitrate dissolved in 170 ml of distilled water and an aqueous solution of 10.2 g of potassium bromide and 2.2 g of sodium chloride dissolved in 100 ml of distilled water while maintaining the mixture at 60° C. over a period of 5 minutes. The formation of thin joined silver halide crystals having a thickness of less than 0.1 μm on the six (100) faces of the cubic host silver halide crystals having a side length of about 0.35 μm was confirmed.

As described above, the junction-type silver halide crystal grains for use in this invention show high surface sensitivity, are excellent in color sensitizing property, and also show very good characteristics such as the occurrence of less desensitization by mechanical pressure and excellent developing speed. It is considered that these merits are based on the large surface area of the silver halide grains, the formation of the concave sites on the grain surfaces facilitating the formation of latent images, the increase of corner portion and edge portions of the silver halide crystals, etc.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising junction-type silver halide crystal grains composed of cubic, rectanguloid, or tetradecahedral silver halide crystals as a first type of silver halide crystal, having projection-joined to at least one of the six (100) faces of said first type of silver halide crystal a second type of silver halide crystal having a different halogen composition from the halogen composition of the surface of said first type of silver halide crystal.

2. An emulsion as in claim 1, wherein said second type of silver halide crystal is silver iodobromide having 4 mole% or less of silver iodide or silver chlorobromide having 2 mole% or less of silver iodide.

3. An emulsion as in claim 1, wherein said emulsion contains 40% or more of junction-type silver halide crystal grains composed of said first type of silver halide crystal having projection-joined to all (100) faces thereof said second type of silver halide crystal, based on the total number of silver halide crystal grains.

4. An emulsion as in claim 1, wherein said emulsion contains 60% or more of junction-type silver halide crystal grains composed of said first type of silver halide crystal having projection-joined to the 4 or more (100) faces thereof said second type of silver halide crystal, based on the total number of silver halide grains.

5. An emulsion as in claim 1, wherein said emulsion contains 85% or more of junction-type silver halide crystal grains composed of said first type of silver halide crystal having projection-joined to the 3 or more (100) faces thereof said second type of silver halide crystal, based on the total number of silver halide grains.

6. An emulsion as in claim 1, wherein the molar ratio of the second type of silver halide crystal to the first type of silver halide crystal is from 0.03/1 to 12/1.

7. An emulsion as in claim 1, wherein the proportion of silver halide grains having a structure such that the projection-joined silver halide crystals formed on each different (100) face of the first type of silver halide crystal are joined with each other over the edge portion(s) of the first type of silver halide crystal or are joined with each other so that they cover the corner portions of the first type of silver halide crystal or the (111) faces of a tetradecahedral first type of silver halide crystal is not over 80% of the total silver halide grains.

8. An emulsion as in claim 1, wherein said first type of silver halide crystal is silver iodochlorobromide containing 10 mole% or less of silver iodide.

9. An emulsion as in claim 1, wherein the first type of silver halide crystal contains 70 mole% or more of silver chloride and 2 mole% or less of silver iodide.

10. A silver halide photographic material comprising a support having thereon at least one silver halide photographic emulsion layer comprising junction-type silver halide crystal grains composed of cubic, rectanguloid, or tetradecahedral silver halide crystals as a first type of silver halide crystal, having projection-joined to at least one of the six (100) faces of said first type of silver halide crystal a second type of silver halide crystal having a different halogen composition from the halogen composition of the surface of said first type of silver halide crystal.

11. A silver halide photographic material as in claim 10, wherein said second type of silver halide crystal is silver iodobromide having 4 mole% or less of silver iodide or silver chlorobromide having 2 mole% or less of silver iodide.

12. A silver halide photographic material as in claim 10, wherein the silver halide photographic emulsion layer contains 40% or more of junction-type silver halide crystal grains composed of said first type of silver halide crystal having projection-joined to all (100) faces thereof said second type of silver halide crystal, based on the total number of silver halide crystal grains.

13. A silver halide photographic material as in claim 10, wherein the silver halide photographic emulsion layer contains 60% or more of junction-type silver halide crystal grains composed of said first type of silver halide crystal having projection-joined to the 4 or more (100) faces thereof said second type of silver halide crystal, based on the total number of silver halide grains.

14. A silver halide photographic material as in claim 10, wherein the silver halide photographic emulsion layer contains 85% or more of junction-type silver halide crystal grains composed of said first type of silver halide crystal having projection-joined to the 3 or more (100) faces thereof said second type of silver halide crystal, based on the total number of silver halide grains.

15. A silver halide photographic material as in claim 10, wherein the molar ratio of the second type of silver halide crystal to the first type of silver halide crystal is from 0.03/1 to 12/1.

16. A silver halide photographic material as in claim 10, wherein the proportion of silver halide grains having a structure such that the projection-joined silver halide crystals formed on each different (100) faces of the first type of silver halide crystal are joined with each other over the edge portion(s) of the first type of silver halide crystal or are joined with each other so that they cover the corner portion of the first type of silver halide crystal or the (111) faces of a tetradecahedral first type of silver halide crystal is not over 80% of the total silver halide grains.

17. A silver halide photographic light-sensitive material as in claim 10, wherein said first type of silver halide crystal contains 10 mole% or less of silver iodide.

18. A silver halide photographic light-sensitive material as in claim 10, wherein the first type of silver halide crystal contains 70 mole% or more of silver chloride and 2 mole% or less of silver iodide.

* * * * *